US006036521A

United States Patent [19]

Tabor et al.

[11] Patent Number: 6,036,521

[45] Date of Patent: Mar. 14, 2000

[54] ISOLATING CIRCUITS IN ELECTRICAL CONNECTOR SYSTEMS

[75] Inventors: William R. Tabor, Livonia; Harry Zaverzence, Macomb Township; Robert A. Burlew, Byron, all of Mich.

[73] Assignee: Electrical Wiring and Connectors Application, Southfield, Mich.

[21] Appl. No.: 09/045,472

[22] Filed: Mar. 20, 1998

[51] Int. Cl.[7] ..... H01R 13/52

[52] U.S. Cl. ..... 439/272

[58] Field of Search ..... 439/272, 271, 439/273, 274, 281, 587

[56] References Cited

U.S. PATENT DOCUMENTS

| | | | |
|---|---|---|---|
| 3,582,186 | 6/1971 | Matzer . | |
| 3,614,055 | 10/1971 | Douglas . | |
| 3,797,512 | 3/1974 | Martin . | |
| 3,804,109 | 4/1974 | Martin et al. . | |
| 4,090,759 | 5/1978 | Herrmann, Jr. | 439/281 |
| 4,109,989 | 8/1978 | Snyder, Jr. et al. | 439/274 |
| 4,130,856 | 12/1978 | Crall et al. . | |
| 4,179,924 | 12/1979 | Tomczack . | |
| 4,284,312 | 8/1981 | Patchett et al. . | |
| 4,664,461 | 5/1987 | Schubert et al. | 439/587 |
| 4,767,897 | 8/1988 | Betterton et al. . | |
| 4,805,460 | 2/1989 | Betterton et al. . | |
| 4,836,792 | 6/1989 | Glover . | |
| 4,936,791 | 6/1990 | Zielinski et al. . | |
| 5,401,174 | 3/1995 | Hansen . | |
| 5,414,229 | 5/1995 | Rocheleau et al. . | |
| 5,435,743 | 7/1995 | Farah . | |
| 5,442,518 | 8/1995 | Beam . | |
| 5,456,620 | 10/1995 | Kaminski . | |
| 5,467,520 | 11/1995 | Nuñez et al. . | |
| 5,551,150 | 9/1996 | Zielinski et al. . | |
| 5,580,226 | 12/1996 | Shelly | 439/281 |
| 5,600,300 | 2/1997 | Povilaitis . | |
| 5,635,630 | 6/1997 | Dawson et al. . | |
| 5,662,491 | 9/1997 | Antilla et al. . | |
| 5,666,810 | 9/1997 | Miesterfeld et al. . | |

*Primary Examiner*—Michael L. Gellner
*Assistant Examiner*—Antoine Ngandjui
*Attorney, Agent, or Firm*—Mark P. Calcaterra

[57] ABSTRACT

A diaphragm seal and sealing assembly for isolating terminal cavities of an electrical connector system in a vehicle. The sealing assembly includes a male connector housing, a diaphragm seal, and a female connector housing. The diaphragm seal includes a floor and a plurality of terminal compression sealing members that extend from the floor of the seal. The terminal compression sealing members have faces with apertures therein, where male blade terminals of the system project through the apertures. The female connector housing compresses the sealing members, and the members isolate the blade terminals from each other. The diaphragm seal also includes at least one retainer button to connect the floor of the seal with the male connector housing of the electrical connector system.

16 Claims, 4 Drawing Sheets

ISOLATING CIRCUITS IN ELECTRICAL CONNECTOR SYSTEMS

BACKGROUND OF THE INVENTION

1. Technical Field

The present invention relates generally to isolating circuits in electrical connector systems, and more particularly to a diaphragm seal and system for isolating the terminal cavities of an electrical connector system in a vehicle.

2. Discussion

Electrical connector systems, such as those used with oxygen sensors, are employed in vehicles to maintain the operating efficiency of the vehicle. Oxygen sensors have long been used in various places on an automobile to determine whether its engine is running and burning fuel efficiently. For example, an oxygen sensor may be used to measure the amount of oxygen in exhaust fumes. The oxygen sensor is typically a metal/ceramic-type unit with wires extending from the sensor, where the wires have teflon coating in order to protect them from the high temperature environment of the oxygen sensor. The oxygen sensor is also preferably assembled with a connector housing. However, because the oxygen sensor is typically located underneath the frame of the automobile or in the engine compartment, the oxygen sensor is exposed to water and other fluids from the road. The oxygen sensor on the automobile is especially exposed to water when the automobile is sent through a car wash containing high pressured jets. Although the oxygen sensor itself may be exposed to moisture, problems exist when the moisture begins to track between the terminals of the oxygen sensor, resulting in inconsistent readings and a possible sensor failure.

The devices currently used to prevent moisture tracking in electrical connector systems in the automotive industry include field connectors, ring seals and compression seals. Field connectors, however, do not prohibit the tracking of water between the plurality of terminal cavities of the oxygen sensor because the connectors are not sealed adequately. Additionally, ring seals and compression seals, although capable of sealing the terminal cavities of the sensor, do not effectively prevent moisture, such as water from a car wash jet, from tracking between the terminals and causing a sensor failure.

Thus, there exists a need in the art for a sealing device that would prevent the tracking of moisture between the terminal cavities of an electrical connector system of a vehicle.

SUMMARY OF THE INVENTION

Accordingly, the present invention provides a diaphragm seal to isolate terminal cavities of an electrical connector system having a plurality of wires with blade terminals, a male connector housing, and a female connector housing. The electrical connector system is preferably, but not limited to, a connector system in a vehicle.

The diaphragm seal comprises a floor or body having first and second sides, and a plurality of terminal compression sealing members containing faces with apertures therein. The sealing members extend from the first side of the floor of the seal. The male blade terminals of the system project through the apertures of the sealing members, the female connector housing compresses the sealing members, and the sealing members isolate the male blade terminals from each other. The diaphragm seal also includes at least one retainer button, where the button extends from the second side of the floor and mates with the male connector housing of the electrical connector system.

The present invention also provides a sealing assembly in a vehicle for isolating terminal cavities of an electrical connector system.

DETAILED DESCRIPTION OF THE PREFERRED EMBODIMENT

Figure 1:
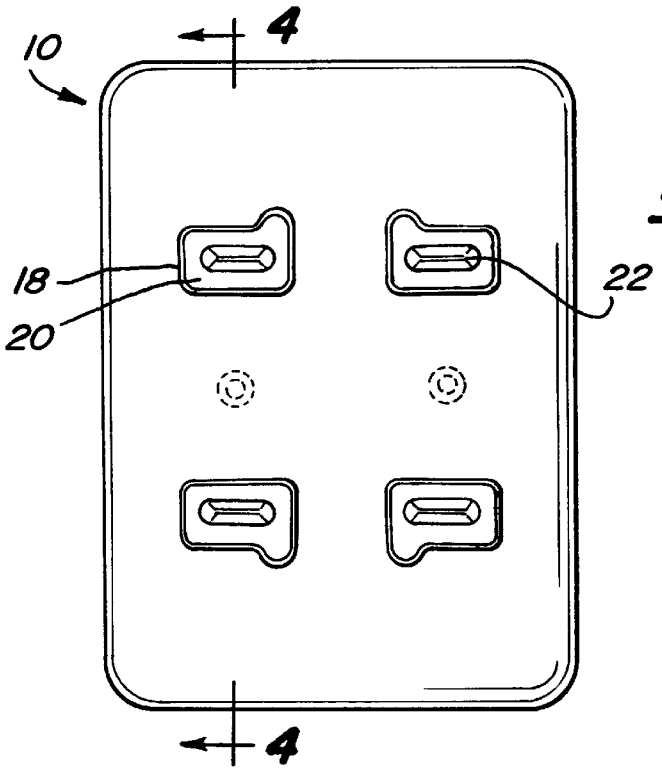
FIG. 1 is a front view of the diaphragm seal.

Referring now to the drawing figures, a diaphragm seal to isolate terminal cavities of an electrical connector system according to a preferred embodiment of the present invention is shown generally at 10. The diaphragm seal of the present invention prevents the tracking of moisture and other elements between the terminals of an electrical connector system, preventing the production of false readings by the system or a system failure. The diaphragm seal of the present invention may be used with any in-line electrical connector system that is used with a device that requires individually sealed terminal cavities in order to function efficiently, preferably a system used with an oxygen sensor, and most preferably a system used with a four-way oxygen sensor in a vehicle.

Figure 2:
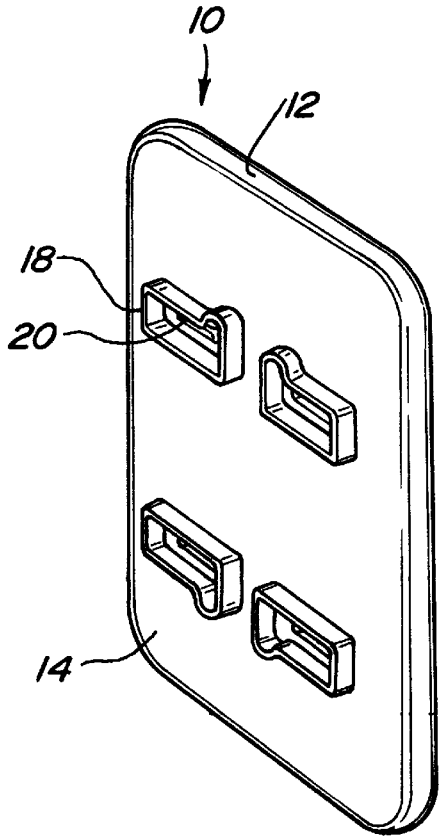
FIG. 2 is a side view of the diaphragm seal.
Figure 3:
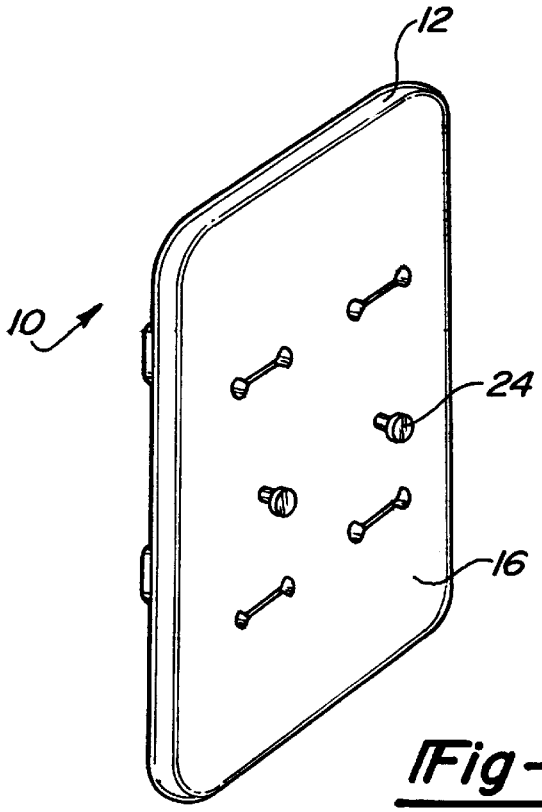
FIG. 3 is a three-dimensional view of the diaphragm seal.

Referring to FIGS. 1, 2, and 3, the diaphragm seal 10 of the present invention includes a floor 12 having a first side 14 and a second side 16. The diaphragm seal also includes a plurality of terminal compression sealing members 18 having faces 20 with apertures 22 therein, where the terminal compression sealing members 18 extend from the first side 14 of the floor of the seal. The diaphragm seal 10 further includes at least one retainer button 24, preferably at least two, which extends from the second side 16 of the floor of the seal.

Figure 4:
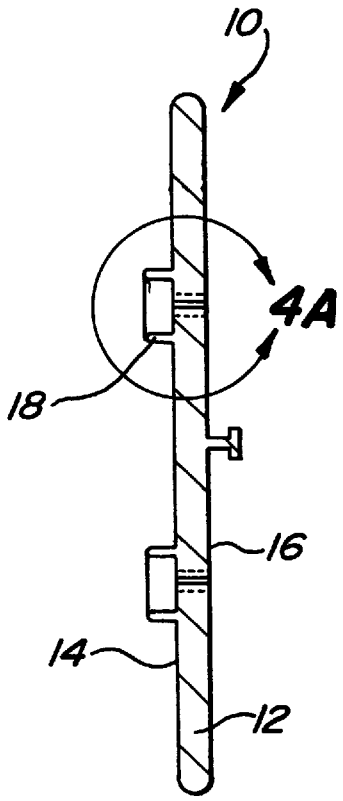
FIG. 4 is a cross-sectional view of the diaphragm seal, taken along the 4—4 line in FIG. 1.
Figure 4A:
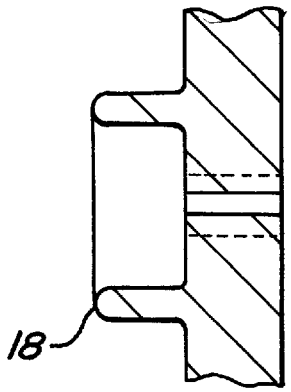
FIGS. 4*a*, 4*b*, and 4*c* are cross-sectional views, taken along the 4—4 line in FIG. 1, of various preferred embodiments of the terminal compression sealing members.
Figure 4B:
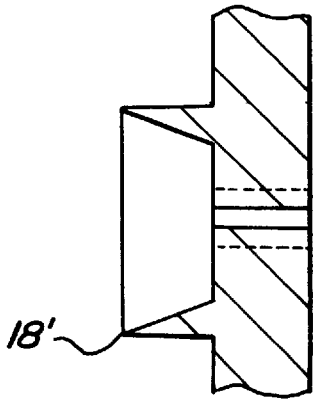
Figure 4C:
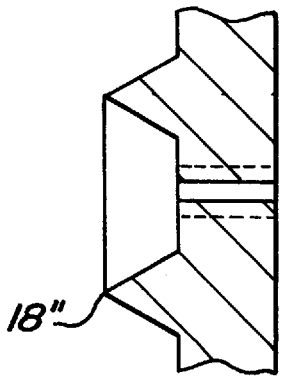

Referring now to FIG. 4, the floor 12 of the seal is preferably, but not limited to, on the order of 0.70 mm in width from the first to the second side of the floor, and the terminal compression sealing members preferably extend at least 1.0 mm above the first side 14 of the floor of the seal. In addition, the sealing members 18 preferably extend for about 0.75 mm in a direction parallel to the first side 14 of the floor and may have different shapes and configurations 18, 18', and 18" as illustrated in FIGS. 4*a*, 4*b*, and 4*c*.

The diaphragm seal is preferably composed of a silicon rubber material in order to provide pliabilty the seal. The seal may also include a lubricant as part of its composition. The silicon rubber material preferably comprises, but is not limited to, ethylene-propylene terpolymer rubber (EPDM), nitrile rubber, and/or mixtures thereof.

Figure 5:
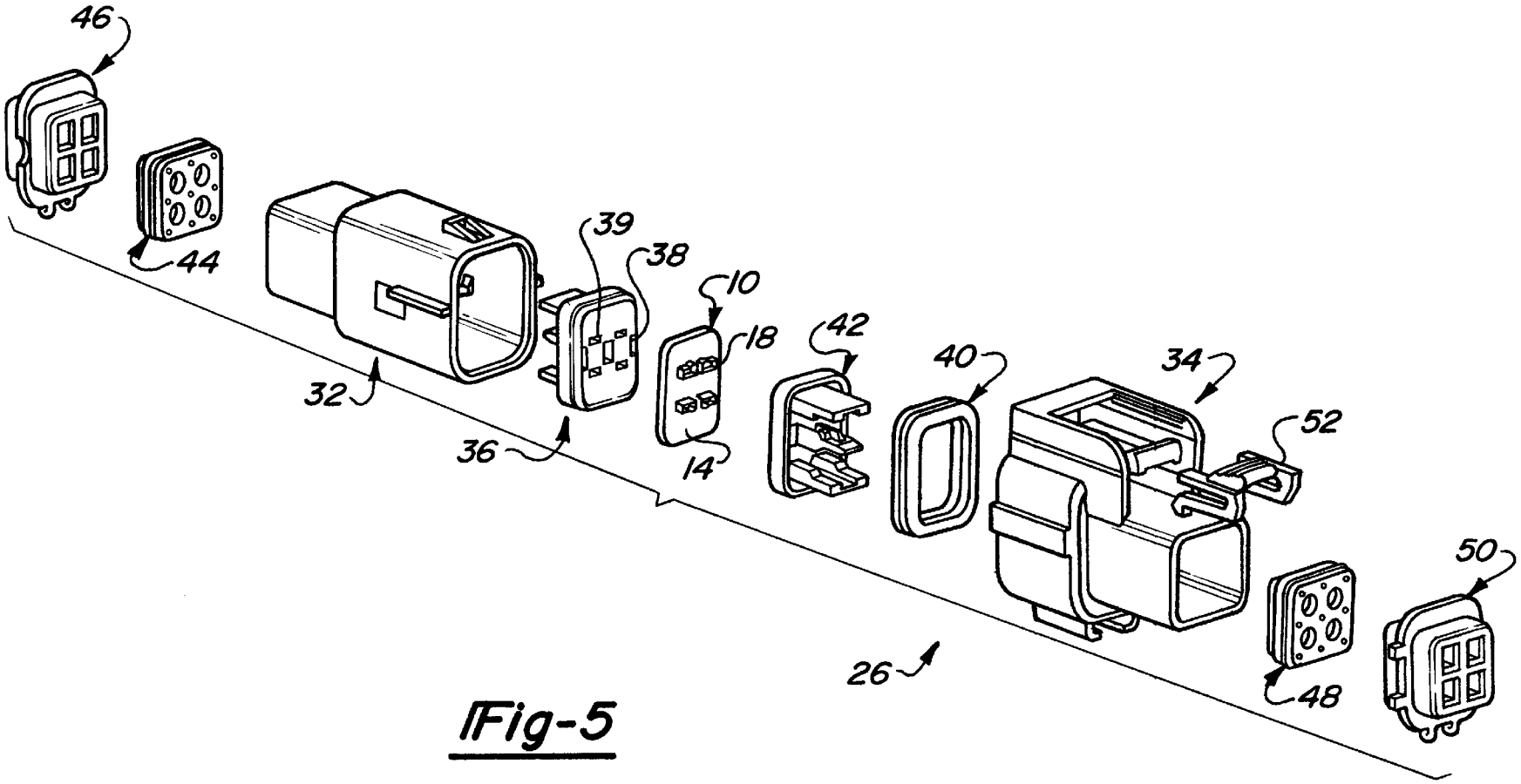
FIG. 5 is an environmental schematic of a sealing assembly for an electrical connector system including the diaphragm seal and connector housing.
Figure 6:
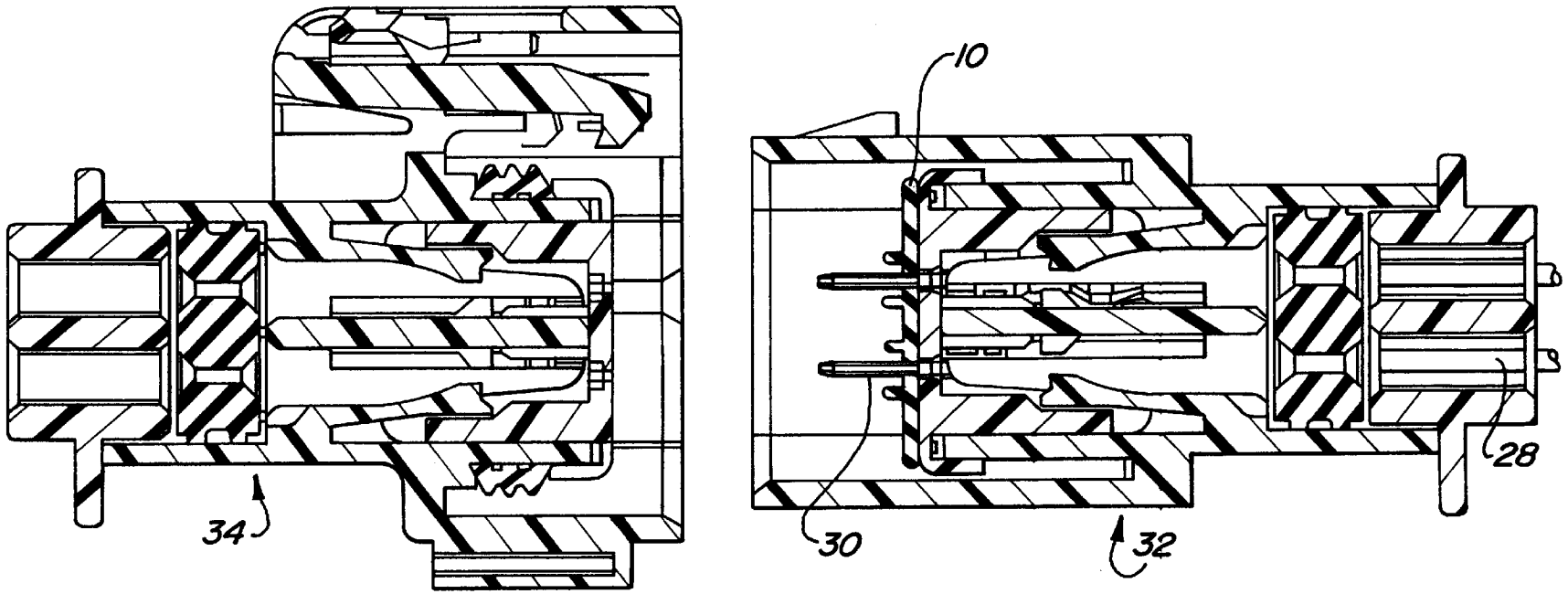
FIG. 6 is a cross-sectional view of the female and male connector assemblies.

Referring now in detail to FIGS. 5 and 6, the present invention also includes as a preferred embodiment a sealing assembly 26 in a vehicle for isolating terminal cavities of an electrical connector system. The sealing assembly generally includes a plurality of wires 28 with male blade terminals 30 and female blade terminals (not shown), a male connector housing 32, female connector housing 34, and diaphragm seal 10. The male blade terminals 30 of said wires 28 extend through the male connector housing 32. The housing includes a male wedge 36 having at least one opening 38, preferably at least two, and further a plurality of apertures 39, preferably at least four.

The diaphragm seal, as previously set forth, comprises a plurality of terminal compression sealing members 18 and at least one retainer button 24, where the retainer button engages with the opening 38 of the male wedge 36 of the male connector housing 32 to securely couple the diaphragm seal to the male connector housing. Additionally, the male blade terminals 30 of the system project through the apertures 39 of the male wedge, through the apertures 22 of the sealing members, and contact the female blade terminals (not shown) of the system.

The sealing assembly also includes a female connector housing 34 comprising a perimeter seal 40 connected to a female wedge 42, where the female connector housing engages over the male connector housing. The coupling of the connector housings compresses the terminal compression sealing members 18, isolating the male blade terminals 30, and subsequently the terminal cavities of the electrical connector system, from each other. The sealing members preferably extend on the order of 0.5 mm above the first side 14 of the floor of the seal after compression by the female wedge 42. Finally, the male blade terminals contact the female blade terminals to provide an electrical connection to the system.

The sealing assembly 26 may also include, but is not limited to, an end seal 44 and end seal retainer 46 for the male connector housing 32, and an end seal 48 and end seal retainer 50 for the female connector housing 34. The end seal 44 and end seal retainer 46 couple together and fit within the male connector housing 32 such that the plurality of wires 28 of the electrical connector system extend through the retainer and seal, and throughout the housing. Similarly, end seal 48 and end seal retainer 50 couple together and fit within the female connector housing 34 such that a plurality of wires with female blade terminals (not shown) extend through the housing. The female connector housing 34 may also contain a connector position assurance component 52, as shown in FIG. 5, having a clip provision to attach the sealing assembly 26 to a portion of the vehicle, such as, for example, underneath the frame of the vehicle or in the engine compartment.

While the above detailed description describes the preferred embodiment of the present invention, the invention is susceptible to modification, variation and alteration without deviating from the scope and fair meaning of the subjoined claims.

What is claimed is:

1. A sealing assembly to protect an electrical system from an external environment and to isolate terminal cavities of an electrical connector system having a plurality of wires, wherein said sealing assembly comprises:

a male housing for male blade terminals, said male housing having an internal space;

a female housing for female receptacle terminals and for selectively engaging over said male housing, said female housing including a perimeter seal; and a diaphragm disposed in said female housing and including a plurality of terminal compression sealing members, each of said plurality of terminal compression members having an aperture therethrough, wherein said male blade terminals of said system project through said apertures of said sealing members, said female connector housing compressing said sealing members, said sealing members isolating said male blade terminals from each other and said internal space of said male housing from said external environment, and said perimeter seal isolating said internal space of said female housing from said external environment.

2. The diaphragm seal of claim 1, wherein said floor of said seal is on the order of 0.70 mm in width from said first to second side of said floor.

3. The diaphragm seal of claim 1, wherein said terminal compression sealing members extend on the order of 1.0 mm above said first side of said floor of said seal.

4. The diaphragm seal of claim 1, wherein said terminal compression sealing members extend on the order of 0.5 mm above said first side of said seal after compression by said female connector housing.

5. The diaphragm seal of claim 1, wherein said terminal compression sealing members extend on the order of 0.75 mm in a direction parallel to said first side of said floor of said seal.

6. The diaphragm seal of claim 1, wherein said diaphragm seal comprises a silicon rubber material.

7. The diaphragm seal of claim 6, wherein said silicon rubber material is selected from the group consisting of ethylene-propylene terpolymer rubber, nitrile rubber, and mixtures thereof.

8. A sealing assembly in a vehicle for isolating terminal cavities of an electrical connector system having a plurality of wires with male and female blade terminals, comprising:

a male connector housing, wherein said male blade terminals of said wires extend through said connector housing, and further wherein said connector housing comprises a male wedge having a plurality of apertures and at least one opening, and a first end seal for sealing said male connector housing about said plurality of wires;

a diaphragm seal having first and second sides, wherein said seal comprises a plurality of terminal compression sealing members that extend from said first side of said seal, said sealing members each having a face with apertures therein, and at least one retainer button that projects from said second side of said seal, wherein said retainer button engages with said opening of said male wedge, and further wherein said male blade terminals of said system project through said apertures of said male wedge and sealing members; and a female connector housing comprising a perimeter seal connected to a female wedge and a second end seal for sealing said female connector housing about said plurality of wires, wherein said female connector housing engages over said male connector housing, compresses said terminal compression sealing members and isolates said male blade terminals from each other, and further wherein said male blade terminals contact said female blade terminals to provide an electrical connection to said system.

9. The assembly of claim 8, wherein said male and female connector housings further comprise an end seal coupled to an end seal retainer through which said wires of said electrical connector system extend.

10. The assembly of claim 8, wherein said floor of said seal is on the order of 0.70 mm in width from said first to second side of said floor.

11. The assembly of claim 8, wherein said terminal compression sealing members extend on the order of 1.0 mm above said first side of said floor of said seal.

12. The assembly of claim 8, wherein said terminal compression sealing members extend on the order of 0.5 mm above said first side of said seal after compression by said female wedge of said female connector housing.

13. The assembly of claim 8, wherein said terminal compression sealing members extend on the order of 0.75 mm in a direction parallel to said first side of said floor of said seal.

14. The assembly of claim 8, wherein said female connector housing further comprises a connector position assurance component.

15. The assembly of claim 8, wherein said diaphragm seal comprises a silicon rubber material.

16. The assembly of claim 15, wherein said silicon rubber material is selected from the group consisting of ethylene-propylene terpolymer rubber, nitrile rubber, and mixtures thereof.

* * * * *